US005903297A

United States Patent [19]

Sasaki et al.

[11] Patent Number: 5,903,297

[45] **Date of Patent: *May 11, 1999**

[54] THERMAL RECORDING APPARATUS

[75] Inventors: Naotaka Sasaki; Shunichi Kawamata; Kenji Sugaya; Atsushi Morita, all of Kiryu, Japan

[73] Assignee: Japan Servo Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,798

[22] Filed: Dec. 18, 1996

[30] Foreign Application Priority Data

Dec. 20, 1995 [JP] Japan ..... 7-348594

[51] Int. Cl.[6] ..... B41J 2/335

[52] U.S. Cl. ..... 347/171; 347/205

[58] Field of Search ..... 347/171, 200, 347/205; 400/120.02, 120.04, 240.3

[56] References Cited

U.S. PATENT DOCUMENTS 5,028,935 7/1991 Warmack et al. ..... 347/205

FOREIGN PATENT DOCUMENTS 0566137A 10/1993 Japan ..... B41J 2/335

*Primary Examiner*—N. Le

*Assistant Examiner*—Anh T.N. Vo

*Attorney, Agent, or Firm*—Birch, Stewart, Kolasch & Birch, LLP

[57] ABSTRACT

Disclosed is a thermal recording apparatus for forming a desired visual image on a recording medium disposed on the opposite side, by utilizing a thermal energy of heating elements provided on a substrate. In the thermal recording apparatus using a thermal head comprising a plurality of substrates on which the heating elements are arranged in line, the joint section of these substrates is positioned in an auxiliary information recording area outside of the image recording width, thus enabling to increase the recording width without deteriorating the recording quality of a visual image to be recorded. That is, in the present invention, one substrate is at least as wide as the image recording area, and another substrate having heating elements also disposed in line is connected to both sides, or one side, of the substrate for image recording, thereby enabling recording the image nearly at the center of the recording medium and also recording an auxiliary information of the image in a margin. The joint of the substrates in the thermal head is provided so as to come in the margin or in a boundary between the image recording area and the auxiliary information recording area.

7 Claims, 3 Drawing Sheets

THERMAL RECORDING APPARATUS

BACKGROUND OF THE INVENTION

1. Field of the Invention

The present invention relates to a thermal recording apparatus utilizing a thermal energy of heating elements provided on substrates for forming a desired visual image on a recording medium oppositely disposed. More particularly, the present invention relates, to a thermal recording apparatus which uses a thermal head composed of a plurality of substrates having a plurality of heating elements arranged in line on each of the substrates for the purpose of providing a wider recording width, to thereby improve a recording quality in recording the visual image on the recording medium.

2. Description of the Prior Art

A thermal printer, thermal transfer printer, facsimile apparatus, and XY plotter have been in practical application as thermal recording devices using a thermal head having a plurality of heating elements arranged in line along the direction of recording width. In these thermal recording apparatus, many heating elements record a specific recording width and are generally deposited in a line on one substrate by a metallizing process, and a thermal head with the least possible deviation of a resistance value of each heating element is adopted to prevent occurrence of a recording density variation. Some of these recording devices require a thermal head having a wide recording width to accomplish their functions. It is, however, very difficult to build, on one substrate, a thermal head corresponding to such a recording width as A2, A1, and A0 sheet sizes specified by ISO because of dimensional limit and yield in the thermal head manufacturing equipment. For example, the dimensional limit of a metallizing oven interior in the manufacturing process is one limitation on size of a thermal head.

In the meantime, thermal transfer color recording adopted in a prepress application is for recording a quality image of ISO or ANSI size within a region of specific width at the central part of the recording chart, and for recording a positioning mark called a crop mark as an auxiliary information in the recording width B' part on either side of the recorded image. Generally, however, the recording of auxiliary information requires little uniformity of recording density as in the image recording area. It is, however, necessary to use a thermal head further extended by at least 2B' in addition to the recording width C' of an actual image in order to record these auxiliary information.

It is from this reason that in a prior art thermal recording devices requiring a wide recording width, a thermal head capable of executing recording in a wide recording width is realized by jointing in one row a plurality of substrates having heating elements of a relatively narrow recording width. To obtain a thermal head having a row of heating elements of a length W, a substrate having a heating element row of the length D and a substrate having a heating element row of the length W-D are connected. At this time, the lengths W and D of the heating element rows have no relation to the width of an image to be recorded; the heating element rows are connected in the relation of D=W/2. As a result, at a connection between the two heating element rows on adjacent substrates, a discontinued deviation of the resistance value is likely to occur between the heating elements, resulting in an increased deviation between adjacent resistance values and accordingly a noticeable variation in the recording density.

This variation in the recording density causes a streak to occur nearly at the center of the image along the direction of travel of the recording chart, resulting in a deteriorated image quality in the case of the thermal recording device in which the image is outputted with a consecutive gradation particularly as in a sublimation type thermal transfer color printer.

SUMMARY OF THE INVENTION

It is an object of the present invention to provide a thermal recording apparatus capable of removing a streak which will deteriorate the image quality.

In the thermal recording apparatus of the present invention, therefore, an image is recorded nearly at the center of a recording medium by a thermal head provided with a plurality of substrates having heating elements arranged in line on the substrates so that auxiliary information on the image is recorded in a margin. In this thermal recording apparatus, the aforementioned object is accomplished by the provision of a joint between the substrates in the thermal head at a boundary area between the margin stated above or the recording area of the image and the recording area of the auxiliary information.

As a result, the joint of the thermal head where a recording density variation is likely to occur comes out of the image recording area, serving as a boundary between the margin in which a slight variation in the recording density is permitted or the image recording area and the auxiliary information recording area, thus substantially preventing the deterioration of the image quality in the image recording area.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
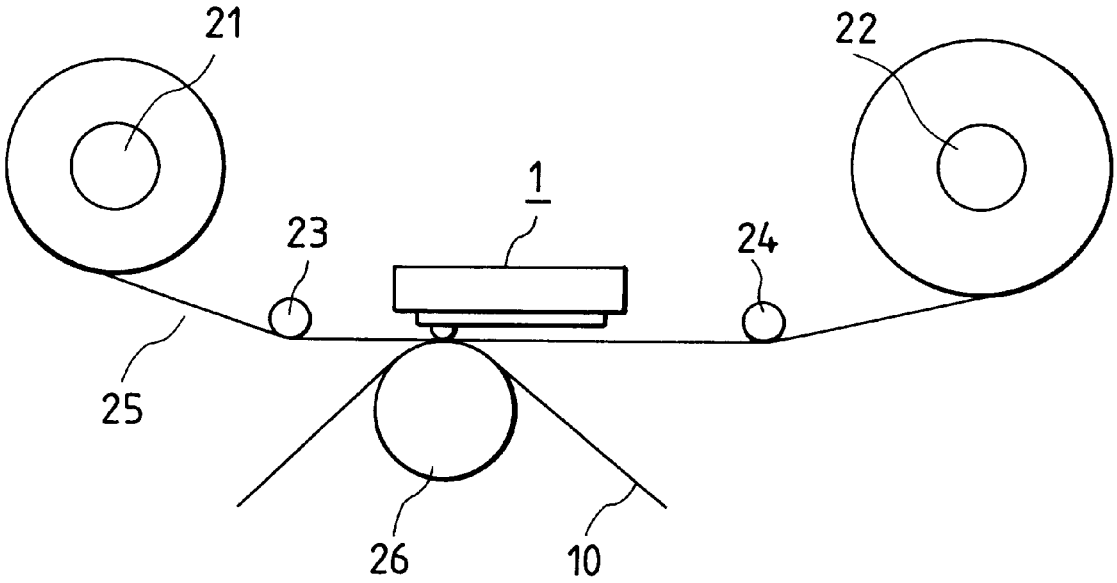
FIG. 1 is view showing a basic construction of a thermal recording apparatus.

One example of a thermal recording apparatus is shown in FIG. 1. FIG. 1 shows the constitution of a thermal transfer color printer using an ink sheet shown in FIG. 2. In FIG. 1 a recording chart 10 and an ink sheet 25 are fed through between a thermal head 1 and a platen roller 26 in order that the ink-coated surface of the ink sheet 25 will be in close contact with the recording chart 10, and are pressed with a predetermined pressure against the platen roller 26 by means of the thermal head 1. In this state, when electric power supply is repeated to the row of heating elements provided for the thermal head 1 while the platen roller 26 is turning, the ink of the ink sheet 25 is transferred to the recording chart to thereby form an image. Reels 21 and 22 feed and wind the ink sheet 25 while rollers 23 support the ink sheet 25 during movement thereof.

Figure 2:
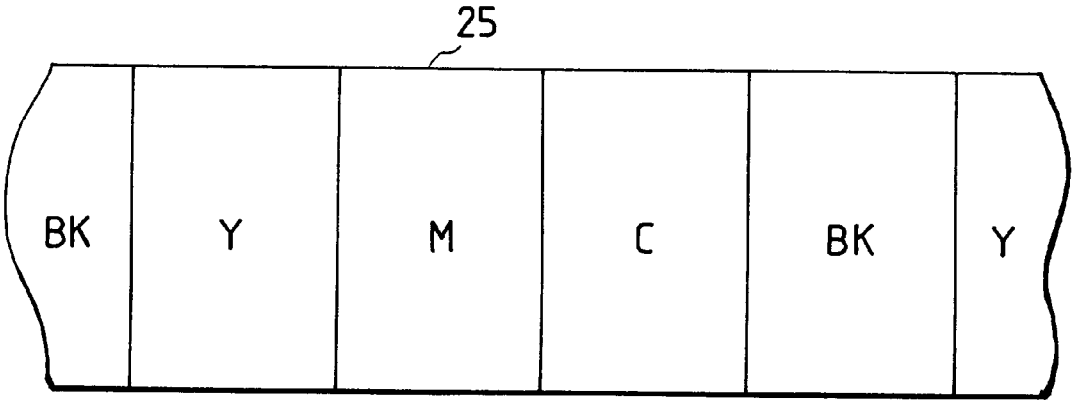
FIG. 2 is a view showing the construction of an ink sheet used in the thermal recording apparatus.

On one side of a base film forming the ink sheet 25, four ink colors including yellow Y, magenta M, cyan C, and black BK are successively coated along the direction of travel of the recording chart as shown in FIG. 2. The length and width of the surface coated with the ink of each color are set slightly larger than a recordable range in the recording apparatus. The ink used for sublimation ink recording contains a sublimation dye, while the ink for melting ink recording contains a mixture of wax and pigment. Also applicable is direct recording on a thermal recording chart by using heating elements of the thermal head 1, not by using the ink sheet 25.

Figure 3:
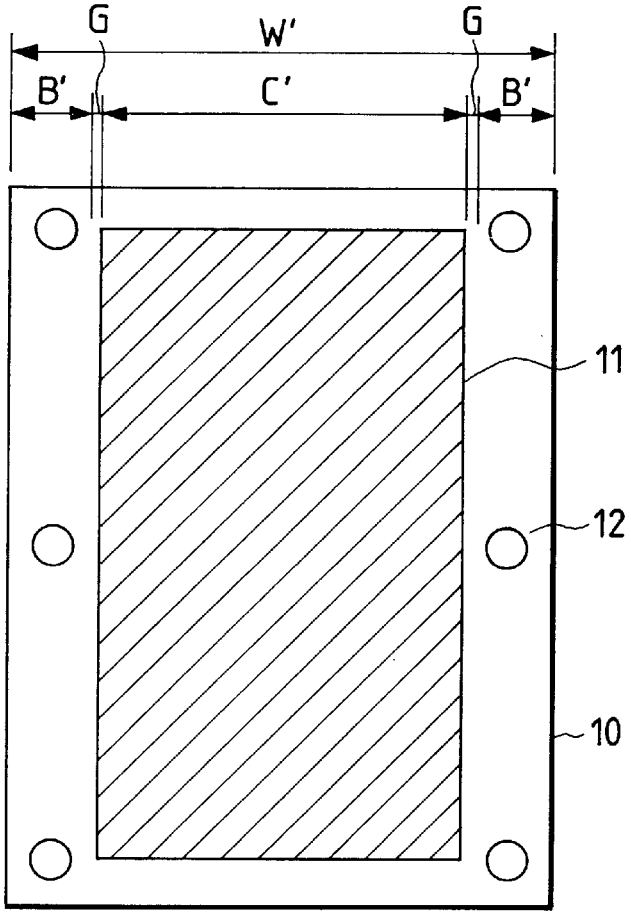
FIG. 3 is the thermal recording apparatus, showing a relationship between an image recording area and an auxiliary information recording area to be recorded on a recording chart.

A visual image to be actually recorded, as shown in FIG. 3, is composed of a recording area 11 for recording an image of recording width C' which is required to have a high image quality on the surface of the recording chart 10 and the crop mark 12 to be recorded as an auxiliary information in the margin of the width B' provided on either side of the recording area 11. Generally, there is provided a slight gap of the width G to prevent interference of the crop mark 12 used for positioning an original plate with a quality image formed in the recording area 11, between the image recording area 11, or the width C' part, and the auxiliary information recording area, such as the crop mark 12, or the width B' part.

Figure 4:
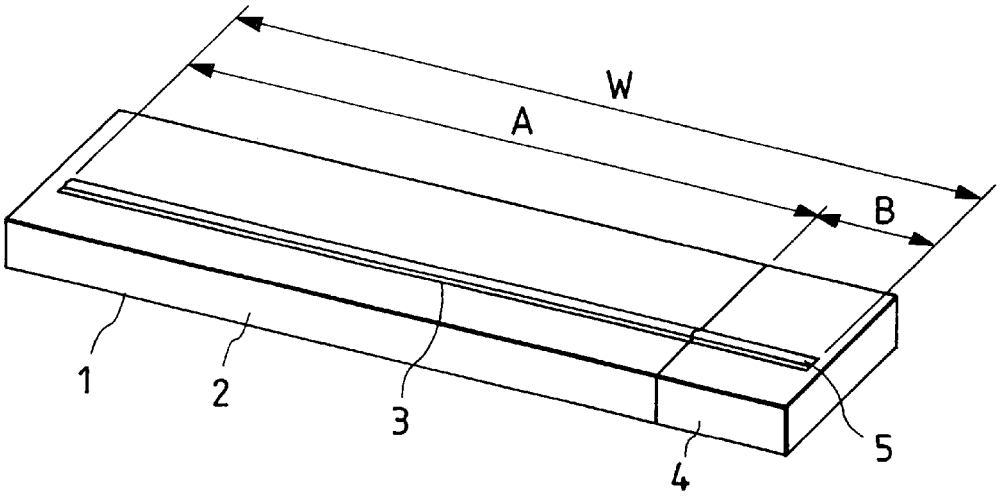
FIG. 4 is a view showing a first example of constitution of a thermal head used in the thermal recording apparatus of the present invention.
Figure 5:
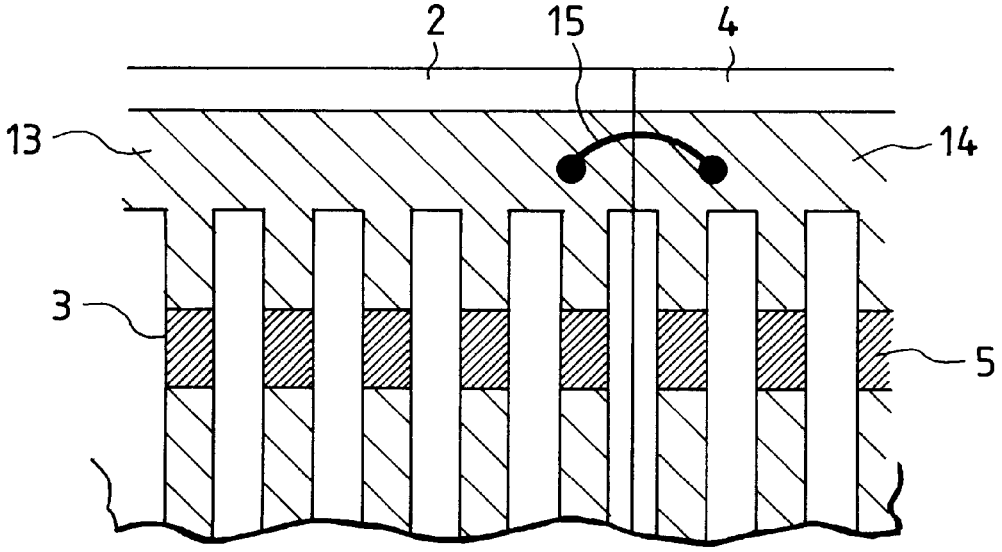
FIG. 5 is a view showing a joint of a thermal head composed of a plurality of substrates.

The first example of constitution of the thermal head 1 used in the thermal recording apparatus of the present invention for recording such a visual image is shown in FIG. 4. In the example given in FIG. 4 two substrates are connected. To obtain the thermal head 1 with the heating element row of the length W, the substrate 2 having the heating element row 3 of the length A and the substrate 4 having the heating element row 5 of the length B are connected with each other. The length W of the heating element row is nearly equal to, or a little shorter than, the sheet width W' of the recording chart 10. Also, the length of each substrate and the combination of an unillustrated recording mechanism section are determined so that a joint between the substrates 2 and 4 will correspond to the position of the gap section of the width G shown in FIG. 3 or the width (B'+G) area including the width of the auxiliary information recording area FIG. 5 shows the construction of the connected section of each substrate. The ends of the substrates 2 and 4 are processed so that the heating elements will be arranged at an equal pitch at the joint; both the substrates are closely jointed by fastening and bonding processes. Each heating element constituting the heating element row 3 on the substrate 2 is connected with a conductive electrode section 13 formed of an electrically conductive material. Similarly each heating element constituting the heating element row 5 on the substrate 4 is connected with a conductive electrode section 14 formed of an electrically conductive material. These heating elements are electrically connected by a jumper wire 15 across the connection for the purpose of holding both the conductive electrode sections 13 and 14 at the same potential. The thermal head 1 comprising a plurality of substrates is connected by the above-described process.

Figure 6:
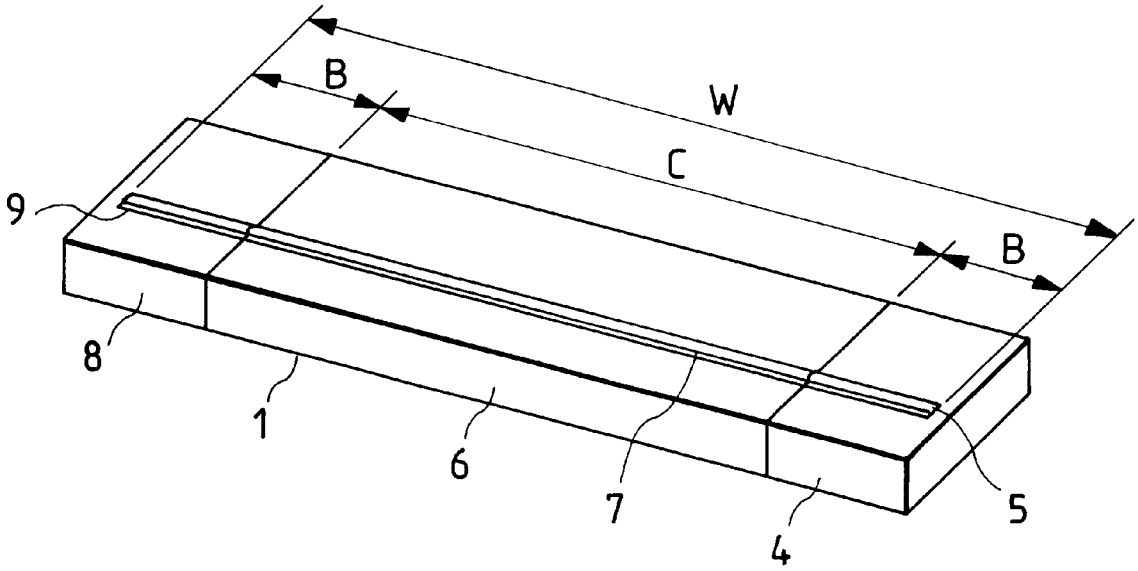
FIG. 6 is a view showing a second example of constitution in the thermal head used in the thermal recording apparatus of the present invention.

Next, a second example of constitution of the thermal head 1 used in the thermal recording apparatus of the present invention is shown in FIG. 6. FIG. 6 gives an example of joint of three substrates. To obtain the thermal head 1 having a heating element row of the length W, a substrate 6 with a heating element row 7 of the length C and the substrate 4 with the heating element row 5 of the length B and a substrate 8 with a heating element row 9 of the same length B are connected. The length W of the heating element row and the paper width W' of the recording chart 10 are set nearly equal as in the first example of constitution, or the length W of the heating element row is a little shorter. A relation between the length of each substrate and the assembling position of the unillustrated recording mechanism section is determined so that the joint between the substrate 6 and the substrate 4 and between the substrate 6 and the substrate 8 will correspond to the gap section of the width G provided on either side of the image recording area width W' shown in FIG. 3, or to the position of the area of width (B'+G) including the width of the auxiliary information recording area The structure of the joint in the second example of constitution is similar to that of the first example of constitution.

According to the present invention, as explained hereinabove, the thermal recording apparatus records an image nearly in the central part of the recording medium by the use of the thermal head with a plurality of substrates having a plurality of heating elements connected in line, and also records auxiliary information about the image in the margin. In this thermal recording apparatus, the substrate joint in the thermal head is provided in the aforementioned margin or in the boundary between the image recording area and the auxiliary information recording area, so that the thermal head connection where uneven recording density is likely to occur will come out of the image recording area, to face the margin in which a more or less variation in the recording density is permitted or in a boundary section between the image recording area and the auxiliary information recording area, thereby substantially preventing deterioration of image quality in the image recording area. The thermal transfer color printer has been explained hereinabove as an example of the thermal recording apparatus of the present invention; however, it is clear that a similar effect is obtainable by applying the present invention to other thermal recording apparatus such as a thermal transfer black-and-white printer, a direct thermal printer using a thermosensitive paper for the recording chart, and a facsimile apparatus.

Although a preferred embodiment of the present invention has been illustrated and described herein it will be understood that the invention is susceptible of various modifications and adaptations within the scope of the appended claims.

What is claimed is:

1. A thermal recording apparatus, comprising:

a first substrate having a first length;

a first heating element disposed on said first substrate;

a second substrate having a second length;

a second heating element disposed on said second substrate, said first length is substantially longer than said second length; and means for connecting said first heating element to said second heating element, said first substrate is connected to said second substrate, said first and said second heating elements include substantially rectangular electrode sections, each rectangular electrode section has a heating element row and a plurality of substantially rectangular openings therein, said first and second heating elements are arranged at a substantially equal pitch at respective joining edges adjacent to said connecting means, said means for connecting includes a jumper wire which connects the first heating element to the second heating element, said first electrode and said second electrode are at the same potential, whereby said first heating element heats a central region of a thermal recording surface while said second heating element heats an edge region of the thermal recording surface to substantially reduce heating discontinuities within the central region of the thermal recording surface.

2. The thermal recording apparatus of claim 1, wherein said means for connecting is a first means for connecting, the apparatus further comprising:

a third substrate having a third length;

a third heating element disposed on said third substrate, said first length is substantially longer than said third length; and second means for connecting said first heating element to said third heating element, said first substrate is connected to said third substrate, whereby said third heating element heats an edge region of the thermal recording surface.

3. The thermal recording apparatus of claim 2, wherein said first, said second, and said third heating elements include substantially rectangular electrode sections, each rectangular electrode section has substantially rectangular openings therein.

4. The thermal recording apparatus of claim 2, wherein said second means for connecting includes a jumper wire which connects the first heating element to the third heating element, whereby said first electrode and said third electrode are at the same potential.

5. The thermal recording apparatus of claim 2, wherein said first, said second, and said third heating elements include substantially rectangular electrode sections, each rectangular electrode section has substantially rectangular openings therein, said first means for connecting includes said first heating element and said second heating element having a respective opening bisected, said second means for connecting includes said first heating element and third heating element having a respective opening bisected, each bisected opening is connected to an opposing bisected opening, whereby said electrode sections form a substantially continuous electrode.

6. The thermal recording device of claim 1, wherein said means for connecting includes said first heating element and said second heating element having a respective opening bisected, each bisected opening is connected to an opposing bisected opening, whereby said electrode sections form a substantially continuous electrode.

7. The thermal recording apparatus of claim 1, further comprising:

a platen roller disposed adjacent to said first and second heating elements;

a plurality of reels disposed adjacent to said first and second heating elements;

an ink sheet disposed between said platen roller and said first and second heating elements, said plurality of reels support and move said ink sheet across said first and second heating elements; and a recording chart disposed between said ink sheet and said platen roller.

* * * * *